US010829996B2

(12) United States Patent
Merzhaeuser et al.

(10) Patent No.: US 10,829,996 B2
(45) Date of Patent: Nov. 10, 2020

(54) DRILLING DEVICE FOR EARTH OR ROCK DRILLING AND METHOD FOR RETROFITTING SUCH A DRILLING DEVICE

(71) Applicant: EURODRILL GmbH, Drolshagen (DE)

(72) Inventors: Markus Merzhaeuser, Olpe (DE); Robin Koester, Bergneustadt (DE)

(73) Assignee: EURODRILL GmbH, Drolshagen (DE)

( * ) Notice: Subject to any disclaimer, the term of this patent is extended or adjusted under 35 U.S.C. 154(b) by 59 days.

(21) Appl. No.: 16/249,384

(22) Filed: Jan. 16, 2019

(65) Prior Publication Data

US 2019/0249496 A1 Aug. 15, 2019

(30) Foreign Application Priority Data

Feb. 13, 2018 (EP) ..... 18156426

(51) Int. Cl.
*E21B 7/24* (2006.01)
*E21B 6/04* (2006.01)
*E21B 17/03* (2006.01)

(52) U.S. Cl.
CPC ..... *E21B 7/24* (2013.01); *E21B 6/04* (2013.01); *E21B 17/03* (2013.01)

(58) Field of Classification Search
CPC ... E21B 7/24; E21B 7/025; E21B 6/04; E21B 17/03; E21B 4/16; E21B 15/00; E21B 3/02; B23B 35/00; B23B 41/02
See application file for complete search history.

(56) References Cited

U.S. PATENT DOCUMENTS 4,574,439 A * 3/1986 Weiblen ..... B23B 41/02 29/27 A
4,809,788 A * 3/1989 Nelson ..... E21B 7/02 173/28
2007/0151377 A1* 7/2007 Roussy ..... E21B 3/02 74/87

FOREIGN PATENT DOCUMENTS

DE 1 220 360 B 7/1966
DE 199 17 538 A1 10/2000
(Continued)

OTHER PUBLICATIONS

European Search Report issued in EP 18 15 6426; issued by the European Patent Office dated Aug. 8, 2018.
(Continued)

*Primary Examiner* — Michael R Wills, III
(74) *Attorney, Agent, or Firm* — Studebaker & Brackett PC

(57) ABSTRACT

A device for earth or rock drilling has a mast, a drill drive with a shaft for rotatably driving a drill rod, a drill drive carriage, on which the drill drive is arranged, movably supported along the mast, and an oscillation generating drive disposed behind the drill drive in a drilling direction connected to the drill rod for transmitting an oscillation. A rear connecting end of the shaft or the drill rod projects rearwards from the drill drive. A rotary coupling with a first coupling piece is provided on the connecting end in an axially fixed and torque-proof manner, and a second coupling piece is axially fixed and rotatable relative to the first coupling piece. The oscillation drive has a clamping means for releasably clamping the second coupling piece, such that in the clamped state an axially fixed connection is formed between the oscillation drive and the second coupling piece.

9 Claims, 1 Drawing Sheet

(56) References Cited

FOREIGN PATENT DOCUMENTS

| | | | |
|---|---|---|---|
| DE | 100 06 973 | C2 | 3/2002 |
| DE | 697 20 480 | T2 | 2/2004 |
| EP | 0 197 456 | B1 | 8/1992 |
| EP | 1 500 780 | A1 | 1/2005 |
| EP | 2 444 587 | B1 | 2/2014 |
| EP | 2 781 269 | A1 | 9/2014 |
| JP | H05-311967 | A | 11/1993 |
| JP | 2002-097883 | A | 4/2002 |
| WO | 2009/014444 | A1 | 1/2009 |

OTHER PUBLICATIONS

Examination Report issued by the Intellectual Proprerty Office of Singapore (dated Nov. 25, 2019), which corresponds to Singaporean Patent Application No. 10201900473T and is related to U.S. Appl. No. 16/249,384.

Search Report issued by the the Intellectual Proprerty Office of Singapore (dated Nov. 25, 2019), which corresponds to Singaporean Patent Application No. 10201900473T and is related to U.S. Appl. No. 16/249,384.

* cited by examiner

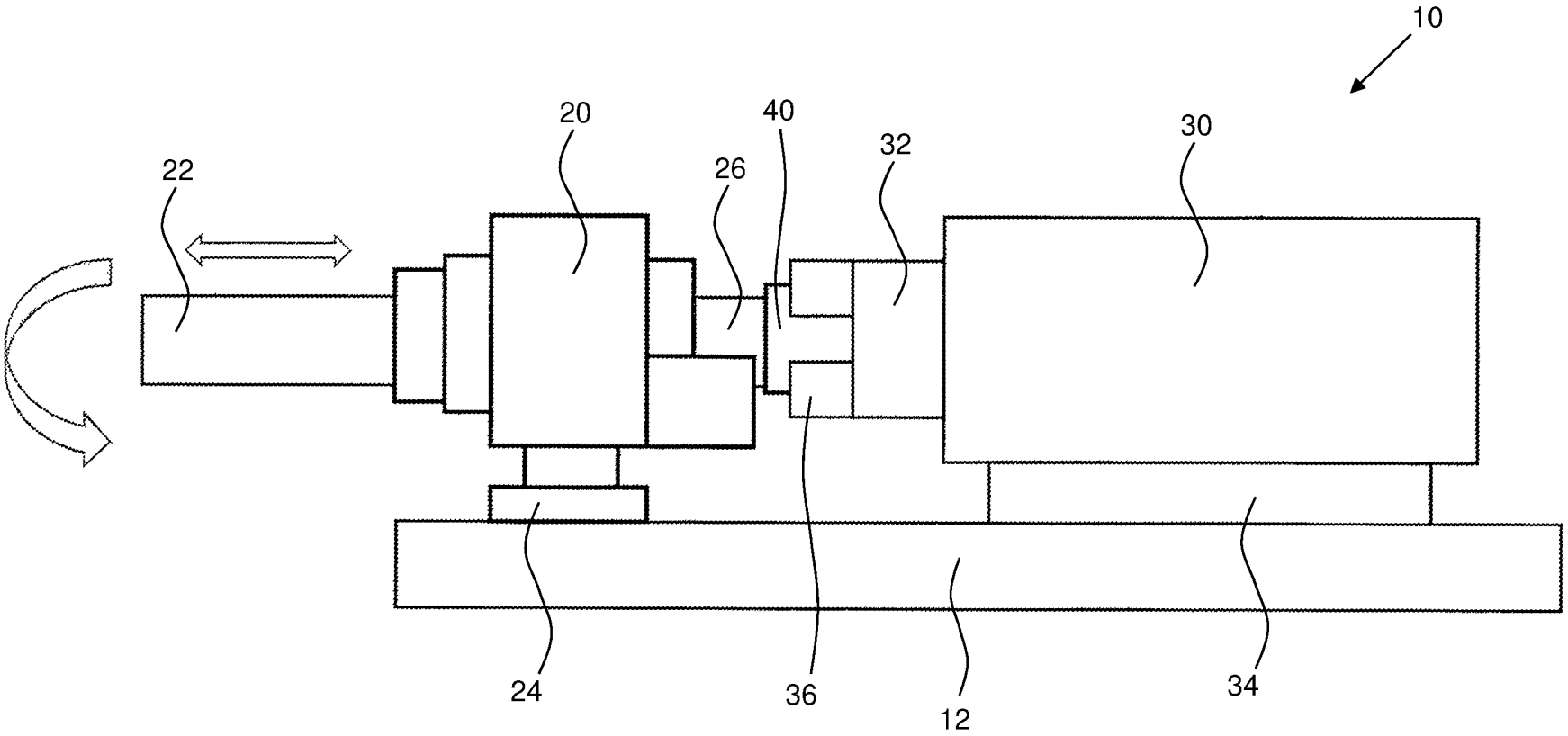
10
30
32
40
26
20
22
34
12
36
24

DRILLING DEVICE FOR EARTH OR ROCK DRILLING AND METHOD FOR RETROFITTING SUCH A DRILLING DEVICE

BACKGROUND OF THE INVENTION

Field of the Invention

The invention relates to a drilling device for earth or rock drilling having a mast, a drill drive with a drill drive shaft for driving a drill rod in a rotating manner, a drill drive carriage, which is supported in a movable manner along the mast and on which the drill drive is arranged, and an oscillation drive which is designed for generating an oscillation, arranged behind the drill drive in a drilling direction and connected to the drill rod for transmitting a vibration, wherein a rear connecting end of the drill drive shaft of the drill drive or the drill rod projects rearwards from the drill drive, in accordance with the preamble of claim 1.

The invention further relates to a method for retrofitting a drilling device for earth or rock drilling having a mast, a drill drive with a drill drive shaft for driving a drill rod in a rotating manner and a drill drive carriage which is supported in a movable manner along the mast and on which the drill drive is arranged, in accordance with the preamble of claim 9.

Description of Related Art

Such drilling devices for earth or rock drilling having a drill drive and an oscillation drive for implementing a so-called vibration drilling or percussion drilling have been known for a long time.

For instance DE 199 17 538 A1 discloses a device and a method for horizontal drilling with a vibration means. The vibration means is connected via an attachment piece, not described in greater detail, to a rotary drive shaft of the drill drive.

DE 100 06 973 C2 discloses a vibratory displacement auger for producing bored piles. By means of a rotary drive fixed on the mast of the drilling apparatus a drill pipe is drilled into the drilling ground. The drill pipe has an oscillation generator with a rotating eccentric weight. In this case, the oscillation generator is integrated in the drill pipe, and in addition no vibration movement is generated in the axial direction.

DE 697 20 480 T2 describes a coupling piece for rotary percussion drilling for a rotary percussion drilling apparatus. On a drill rod a rotary percussion apparatus is mounted via a connection that is not described in greater detail and comprises a splined connection.

From EP 0 197 456 B1 a down-the-hole drilling device can be taken, in which a vibration drive is positioned in a frontal area of the down-the-hole drill while a rotary drive is located in a rear area. A connection is provided via a universal joint.

From DE 1 220 360 a rock drilling means with an annular core bit designed for percussion drilling can be taken. In particular, a connection between a hammer piston and a rotary converter is shown.

The known drilling apparatuses with an oscillation drive that can also comprise percussion are mainly special developments. Due to the limited numbers of such special drilling apparatuses correspondingly high apparatus costs result.

BRIEF SUMMARY OF THE INVENTION

The invention is based on the object to provide a drilling device which, whilst being of simple construction, is also able to carry out drilling in combination with a generation of oscillations. Furthermore, it is the object of the invention to provide a method for retrofitting such a drilling device.

The object is achieved on the one hand by a drilling device having the features of claim 1 and on the other hand by a method for retrofitting a drilling device according to the features of claim 9. Preferred embodiments are stated in the dependent claims.

BRIEF DESCRIPTION OF THE DRAWING

The FIGURE is a schematic side view of a drilling device according to an embodiment of the present disclosure.

DETAILED DESCRIPTION OF THE INVENTION

The drilling device according to the invention is characterized in that on the connecting end a rotary coupling with a first coupling piece, which is connected in an axially fixed and torque-proof manner to the connecting end, and a second coupling piece, which is axially fixed and rotatable relative to the first coupling piece, is provided, and in that the oscillation drive has a clamping means which is designed for releasably clamping the second coupling piece, wherein in the clamped state an axially fixed connection is formed between the oscillation drive and the second coupling piece.

A basic idea of the invention can be seen in the fact that in a drilling device for earth or rock drilling a separate oscillation drive is additionally provided that can be releasably coupled to the drill drive. The terms oscillation drive and oscillation are to be understood in a general sense, whereby they can generally comprise not only a vibration but also a percussion or a different kind of oscillation. The oscillation drive can be additionally connected to the drill drive according to requirement.

According to the invention the drill drive is specifically designed such that a connecting end of the drill drive shaft of the drill drive or the drill rod itself projects rearwards from the housing of the drill drive. On the connecting end a first coupling piece of a rotary coupling is mounted in an axially fixed and torque-proof manner. The rotary coupling furthermore comprises a second coupling piece which is arranged on the first coupling piece in an axially fixed and rotatable manner relative thereto. The second coupling piece is designed such that it can be gripped by a clamping means on the oscillation drive so that a connection transmitting the oscillation of the oscillation drive is created via the rotary coupling to the drill drive shaft. Thus, in a clamped state a drilling in combination with targeted oscillations can take place which leads to an increased drilling progress in certain ground conditions. In this, the entire drill drive can also be set into oscillation. The drill drive can also be of annular design, with the drill rod projecting rearwards from the drill drive. Correspondingly, the described rotary coupling can be provided on the rear connecting end of the drill rod.

If no oscillation is required the clamping means can be released and the oscillation drive can be uncoupled from the drill drive. This generally reduces an internal friction of the entire drive arrangement during drilling operation. This also conserves the drives, reduces maintenance works and all in all leads to an increased service life of the drive arrangement.

Due to the releasable connection and arrangement of the oscillation drive to the drill drive the oscillation drive can be provided and offered as an additional option for regular drilling devices. In addition, a retrofitting of existing drilling devices is basically possible.

Basically, the clamping means can be of any chosen design to create a suitable oscillation-transmitting connection between the oscillation drive and the drill drive shaft.

According to an embodiment of the invention it is especially preferred that the clamping means in particular has a clamping collet with radially adjustable clamping claws for the force- and form-locking connection. By way of the clamping means a force- and/or form-locking connection to the second coupling piece of the rotary coupling can generally be created. The clamping is effected via an active clamping actuation.

Another advantageous embodiment of the invention resides in the fact that the oscillation drive is mounted on an oscillation drive carriage which is movable relative to the drill drive carriage. The oscillation drive carriage is preferably arranged in a displaceable manner along a mast. For displacement a separate displacement drive can be provided that can comprise a positioning cylinder or a rope winch. By means of a control the oscillation drive can thus be moved between an operating position, in which it can be coupled via the clamping means to the drill drive, and a retracted position, in which the oscillation drive with the oscillation drive carriage is spaced apart from the drill drive.

According to a further development of the drilling device according to the invention it is advantageous that after release of the clamping means the oscillation drive carriage with the oscillation drive can be separated and removed from the drill drive. In this way, the oscillation drive carriage with the oscillation drive can be removed from the direct operating area of the drill drive. This conserves the oscillation drive.

Basically, the oscillation drive can be designed in any chosen and known manner in order to generate targeted oscillations that can be transmitted to a rotating drilling tool. In particular, this can also be a percussive generation of oscillations. According to an embodiment of the invention it is especially preferred that the oscillation drive is designed as a vibrator.

In this connection it is particularly advantageous that the vibrator has at least a pair of rotationally driven unbalanced units. In particular, several rotationally driven unbalanced units can be arranged that are adjustable to each other. This allows an almost infinitely variable setting and a targeted direction of the vibrations, in particular in the drilling direction. The vibrator can also be designed with an axial piston driven in an oscillating manner for the generation of oscillations.

According to another preferred embodiment variant of the invention provision is made for the mast to be arranged in a substantially vertical manner. The mast can be a rigid mast with a linear guide or a so-called leader. The mast can in particular be supported by being pivotable to a certain degree about a vertical axis or by being tiltable thereto.

A further conserving embodiment of the drilling device according to the invention can be seen in the fact that the oscillation drive is supported in an oscillation-damping manner on the oscillation drive carriage. In particular, a substantial uncoupling of the oscillation drive from a base carriage can be achieved, for instance by arranging rubber bearings in-between. Through this, an excessive transmission of oscillations from the oscillation drive to the mast and the drilling apparatus as a whole can be prevented.

The method according to the invention for retrofitting a drilling device for earth or rock drilling is characterized in that on a rear connecting end of the drill drive shaft of the drill drive or the drill rod a rotary coupling with a first coupling piece, which is connected in an axially fixed and torque-proof manner to the connecting end, and a second coupling piece, which is axially fixed and rotatable relative to the first coupling piece, is provided and in that behind the drill drive an oscillation drive with a clamping means is arranged which is designed for releasably clamping the second coupling piece, wherein in the clamped state an axially fixed connection is formed between the oscillation drive and the second coupling piece.

With this method it is generally possible to retrofit conventional drilling devices hitherto designed without an oscillation drive. In doing so, the oscillation drive can in particular be arranged on an oscillation drive carriage movable along a guide on the mast, on which the drill drive is also moved with a drill drive carriage. In this way, an existing drilling device can be provided efficiently and according to requirement with an additional vibration or oscillation means.

By way of the method according to the invention the previously described drilling device can be produced in particular. The advantages described beforehand can be achieved thereby.

The invention is described further hereinafter by way of a preferred embodiment illustrated schematically in the accompanying drawing.

A drilling device 10 according to the invention is shown schematically in side view in the drawing. The drilling device 10 has a drill drive 20 and an oscillation drive 30 which is arranged behind the drill drive 20 in the drilling direction. The drill drive 20 is supported on a drill drive carriage 24 and supported in a displaceable manner along a linear guide, not shown in greater detail, on a mast 12 that is illustrated in shortened form only. Correspondingly, the oscillation drive 30 is supported via an oscillation drive carriage 34 along the linear guide on the mast 12. The mast 12 is preferably arranged on a carrier vehicle not shown.

The drill drive 20 has a drill drive shaft 22 that can be connected at its front end to a drill rod not depicted. The drill drive 20 which comprises a hydraulic motor in particular generates a torque that is transmitted via the drill drive shaft 22 to the drill rod. The drill drive shaft 22 is supported in an axially displaceable manner in a housing of the drill drive 20, with a rear connecting end 26 projecting in the rearward direction. The rear connecting end 26 is connected to the drill drive shaft 22 and constitutes in particular the rear end of the drill drive shaft 22. On the rear connecting end 26 a rotary coupling 40 is mounted that has a first coupling piece and a second coupling piece, not illustrated in greater detail. The first coupling piece of the rotary coupling 40 is connected in an axially fixed and torque-proof manner to the rear connecting end 26 of the drill drive shaft 22. The second coupling piece of the rotary coupling 40 is supported by being axially fixed to the first coupling piece and rotatable relative to the first coupling piece.

The oscillation drive 30 which in particular has a vibrator with several rotationally driven unbalanced elements comprises a frontal clamping means 32 directed towards the drill drive 20. In particular, the clamping means 32 is a clamping collet with radially adjustable clamping claws 36. By way of the clamping claws 36 of the clamping means 32 the second coupling piece can be gripped in a force-locking and/or form-locking manner. In this way, a vibration or oscillation movement generated by the oscillation drive 30 and directed in the drilling direction can be transmitted to the second coupling piece and from there to the first coupling piece of the rotary coupling 40. Due to the axially fixed connection of the first coupling piece to the rear connecting end 26 of the drill drive shaft 22 this vibration or oscillation movement is transmitted from the first coupling piece to the said drill drive shaft. Thus, in the illustrated operating state a rotary movement of the drill drive shaft 22 that is generated by the drill drive 20 can be combined or superimposed with an axially directed vibration or oscillation movement, as indicated by the illustrated arrows.

Via non-depicted damping elements arranged between the housing of the oscillation drive 30 and the oscillation drive carriage 34 a direct transmission of oscillations from the oscillation drive 30 to the mast 12 can be prevented or at least reduced to a large extent. A corresponding damping can also be arranged between the housing of the drill drive 20 and the drill drive carriage 24.

If no superimposed vibration or oscillation movement is required for the drilling operation the clamping means 32 can be released. For this, the clamping claws 36 are moved radially outwards, whereby the connection to the rotary coupling 40 is released. In this released position the oscillation drive 30 can then be moved rearwards along the mast 12 via a non-depicted adjustment drive and thereby be spaced apart from the drill drive 20. Conversely, by moving drill drive 20 and oscillation drive 30 towards each other the two drives can be combined again. The unit thus formed of drill drive 20 and oscillation drive 30 can then be uniformly moved along the mast 12.

The releasable arrangement of the oscillation drive 30 renders it possible in accordance with the invention that even existing drilling devices 10 can be subsequently provided with an oscillation drive 30.

The invention claimed is:

1. Drilling device for earth or rock drilling having a mast, a drill drive with a drill drive shaft for driving a drill rod in a rotating manner, a drill drive carriage, which is supported in a movable manner along the mast and on which the drill drive is arranged, and an oscillation drive which is designed for generating an oscillation, arranged behind the drill drive in a drilling direction and connected to the drill rod for transmitting an oscillation, wherein a rear connecting end of the drill drive shaft of the drill drive or the drill rod projects rearwards from the drill drive, wherein on the connecting end a rotary coupling with a first coupling piece, which is connected in an axially fixed and torque-proof manner to the connecting end, and a second coupling piece, which is axially fixed and rotatable relative to the first coupling piece, is provided and in that the oscillation drive has a clamping means which is designed for releasably clamping the second coupling piece, wherein in the clamped state an axially fixed connection is formed between the oscillation drive and the second coupling piece.

2. Drilling device according to claim 1, wherein the clamping means has a clamping collet with radially adjustable clamping claws for the force- and/or form-locking connection.

3. Drilling device according to claim 1, wherein the oscillation drive is mounted on an oscillation drive carriage which is movable relative to the drill drive carriage.

4. Drilling device according to claim 3, wherein after release of the clamping means the oscillation drive carriage with the oscillation drive (30) can be separated and removed from the drill drive.

5. Drilling device according to claim 1, wherein the oscillation drive is designed as a vibrator.

6. Drilling device according to claim 5, wherein the vibrator has at least a pair of rotationally driven unbalanced units and/or at least one oscillating piston.

7. Drilling device according to claim 1, wherein the mast is arranged in a substantially vertical manner.

8. Drilling device according to claim 1, wherein the oscillation drive is supported in an oscillation-damping manner on the oscillation drive carriage.

9. Method for retrofitting a drilling device for earth or rock drilling, in particular according to claim 1, having a mast, a drill drive with a drill drive shaft for driving a drill rod in a rotating manner and a drill drive carriage which is supported in a movable manner along the mast and on which the drill drive is arranged, wherein on a rear connecting end of the drill drive shaft of the drill drive or the drill rod a rotary coupling with a first coupling piece, which is connected in an axially fixed and torque-proof manner to the connecting end, and a second coupling piece, which is axially fixed and rotatable relative to the first coupling piece, is provided and in that behind the drill drive an oscillation drive with a clamping means is arranged which is designed for releasably clamping the second coupling piece, wherein in the clamped state an axially fixed connection is formed between the oscillation drive and the second coupling piece.

* * * * *